US007490490B2

(12) United States Patent
Hirasawa et al.

(10) Patent No.: US 7,490,490 B2
(45) Date of Patent: Feb. 17, 2009

(54) DRUM TYPE WASHING MACHINE

(75) Inventors: Yuji Hirasawa, Osaka-fu (JP); Tomonari Kawaguchi, Osaka-fu (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 559 days.

(21) Appl. No.: 11/143,489

(22) Filed: Jun. 3, 2005

(65) Prior Publication Data

US 2005/0268670 A1 Dec. 8, 2005

(30) Foreign Application Priority Data

Jun. 4, 2004 (JP) ..... 2004-166507

(51) Int. Cl.
*D06F 33/02* (2006.01)
*D06F 37/38* (2006.01)

(52) U.S. Cl. ..... 68/12.04; 68/12.06; 68/23.1; 68/24

(58) Field of Classification Search ..... 68/12.04, 68/12.06, 12.16, 23 R, 23.1, 24
See application file for complete search history.

(56) References Cited

U.S. PATENT DOCUMENTS 6,029,299 A * 2/2000 Baek et al. ..... 8/159
6,158,072 A * 12/2000 Baek et al. ..... 8/159
6,393,918 B2 * 5/2002 French et al. ..... 73/660
7,059,002 B2 * 6/2006 Lee et al. ..... 8/158

FOREIGN PATENT DOCUMENTS

| | | |
|---|---|---|
| EP | 1 548 169 A1 | 6/2005 |
| JP | 8-876 | 1/1996 |
| KR | 2003-0044245 A | 6/2006 |
| WO | 2004/009899 A1 | 1/2004 |

* cited by examiner

*Primary Examiner*—Joseph L Perrin
(74) *Attorney, Agent, or Firm*—Westerman, Hattori, Daniels & Adrian, LLP.

(57) ABSTRACT

The present invention provides a drum type washing machine capable of adequately distributing the laundry articles along the inner circumferential wall of the drum at the start-up of the dehydrating operation with high probability, thereby reducing the start-up time of the dehydration. In an embodiment of the present invention, the drum is controlled to rotate at a constant speed 50 r.p.m. to agitate the laundry articles (Step S12), and the drum speed is almost continuously monitored. If the change in the speed does not exceed 1.5 r.p.m. for 0.5 second (Steps S13 through S16), the laundry articles are loosened and easy to distribute. Therefore, the drum speed is raised to 80 r.p.m. (Steps S17 and S18). If the eccentric load detected at this speed does not exceed a predetermined value (Steps S19 and S20), the laundry articles are adequately distributed along and pressed onto the inner circumferential wall of the drum. If a sudden change in the speed has been detected within a short period of time that is less than 36 milliseconds (Step S22), the laundry articles are tangled in a mass form. Therefore, the rotating direction of the drum is reversed, and the agitating direction is restarted in the opposite direction (Step S21).

5 Claims, 7 Drawing Sheets

WHEN LIQUID IS EVENLY DISTRIBUTED

WHEN DRUM IS DECELERATED

AFTER BALANCING OPERATION

AGITATING OPERATION AT 50RPM
(SPEED CHANGE: SMALL)

AFTER RAISING SPEED
FROM 50 TO 80RPM

AGITATING OPERATION AT 50RPM
(SPEED CHANGE: LARGE)

DRUM TYPE WASHING MACHINE

The present invention relates to a drum type washing machine and more specifically to a technique for suppressing or reducing vibration incurred during the rotary dehydration process.

BACKGROUND OF THE INVENTION

In a drum type washing machine, an approximately cylindrical drum having a circumferential wall with a large number of perforations is mounted on a horizontal or inclined rotation shaft. In the dehydrating operation, the drum is rotated at high speeds so that the laundry contained in the drum is squeezed and the water held therein is removed. In this type of washing machine, an uneven distribution of the laundry on the inner circumferential wall will cause a mass imbalance (i.e. an eccentric load) around the rotation shaft. In this state, the drum strongly vibrates if it is rotated at a high speed. The vibration of the drum leads to a vibration of the outer tub enclosing the drum. The outer tub in turn collides with the inside of the housing and causes it to vibrate. As a result, an abnormal vibration and noise occurs. Therefore, for drum type washing machines, it is very important to reduce the vibration and noise during the rotary dehydrating operation.

In drum type washing machines, if an adequate amount of laundry articles are contained in the drum, it is often possible to reduce the eccentric load of the drum by appropriately distributing the laundry articles along the inner circumferential wall of the drum. For this purpose, it is necessary to loosen the laundry articles because they are usually tangled with each other after the washing or rinsing process. Therefore, in a conventional drum type washing machine, a specific kind of operation, called the agitating operation, is carried out, in which the drum motor is controlled so that the drum rotates at low speeds of about 40 to 60 r.p.m. to agitate and loosen the laundry articles for a predetermined period of time and subsequently the drum speed is raised to a level at which the laundry articles are pressed on the inner circumferential wall of the drum by centrifugal force.

However, the above-described conventional control method does not always ensure that the drum speed is raised at a good timing when the laundry articles are adequately loosened and easy to distribute. Therefore, the possibility of appropriately distributing the laundry articles into a state where the eccentric load is adequately small is weak. If the eccentric load is still large when the drum speed is raised, it is necessary to lower the speed to carry out the agitating operation again and then raise the speed. Repeating such a process often requires a very long time until the dehydration process is actually started.

A conventional method for determining an appropriate timing for changing the drum speed from a low level for loosening the laundry to a high level is known from the Japanese Unexamined Patent Publication No. H8-876. The drum type washing machine disclosed in this Publication includes a vibration sensor for measuring the amplitude of the vibration of the outer tub. The sensor is used for detecting an abnormal vibration of the outer tub while the drum is rotated at a low speed for loosening the laundry. If no abnormal vibration is detected, the drum speed is raised, whereas the loosening operation is continued in the case an abnormal vibration has been detected. This control method prevents the drum speed from being unnecessarily raised when the laundry is still in a mass form that is hard to distribute. Usually, however, once the outer tub starts a strong vibration due to an uneven distribution of the laundry during the low speed rotation of the drum, the vibration will not immediately fade away even after the laundry is adequately distributed. Therefore, it is necessary to wait for a certain period of time until the next detection of the vibration. This means that it is impractical to continuously check and determine the massing or gathering state of the laundry during the low speed rotation of the drum.

Except for the case where the laundry articles are tightly tangled, the state of the laundry continuously changes with time during the low speed rotation of the drum. For example, even if the laundry articles are relatively loosened and moving separately inside the rotating drum at a certain point in time, they may soon be in a different state where plural pieces of laundry articles are overlapped and gathered in the form of a mass that rolls or falls without being separated. Therefore, it is essential to continuously check the state of the laundry contained in the drum, otherwise the drum speed cannot be raised at the best timing where the laundry is adequately distributed. For this reason, the aforementioned conventional washing machine often fails to detect the best timing for increasing the drum speed and resultantly takes a long time for the loosening operation.

In the case the laundry is tightly tangled in a mass form, there is only a small chance that the laundry articles will be loosened by continuing the loosening operation for a long period of time. However, the aforementioned conventional washing machine cannot distinguish the case where the laundry is in the form of an extremely tight mass from the case where the laundry is a simple pile of laundry articles that are not tightly tangled. As a result, the loosening operation often continues even in the former case where the loosening effect is least expected, consuming an unnecessarily long period of time until the start of the dehydration process.

To address the above-described problems, the present invention aims to provide a drum type washing machine capable of efficiently distributing the laundry articles to reduce the eccentric load in the initial phase of the dehydration process, so that not only the time consumed until the dehydrating operation but also the total operation time are shortened.

SUMMARY OF THE INVENTION

To solve the above-described problems, the present invention provides a drum type washing machine for carrying out the dehydration of laundry articles by rotating a drum with the laundry articles contained therein at a high speed around a horizontal or inclined rotation shaft, which includes:

a motor for rotating the drum;

a speed change detector for detecting the change in the speed of the drum under the condition that the motor is controlled to rotate at a constant speed so that the drum rotates at a first speed for an agitating operation that agitates the laundry articles contained in the drum at the start-up of a dehydrating operation; and a dehydration start-up controller for controlling the motor so that the speed of the drum is raised to a speed where the laundry articles are pressed onto the inner circumferential wall of the drum by centrifugal force when the change in the speed detected by the speed change detector is smaller than a predetermined value.

In the drum type washing machine according to the present invention, the speed change detector almost continuously detects the change in the speed of the drum under the condition that the motor is controlled to rotate at a constant speed so that the speed of the drum is maintained at a first speed. The speed change will be approximately zero if the drum contains no laundry articles. If there are laundry articles contained in the drum, some of the laundry articles roll down with the rotation of the drum, while others are lifted up to a certain level and then fall. In this process, the drum receives an accelerating or decelerating force, depending on the motion of the laundry. Meanwhile, the laundry articles changes their state with the lapse of time. When the laundry articles have been loosened so that they can move separately, the accelerating or decelerating force due to their motions becomes small, or the acceleration and the deceleration cancel each other, so that the speed change becomes small.

The dehydration start-up controller detects the timing where the speed change becomes smaller than a predetermined value and then accelerates the drum to a speed where the laundry articles are pressed onto the inner circumferential wall of the drum by centrifugal force. Immediately before the acceleration, the laundry articles are easy to separate and they rarely form an abnormally large pile or mass, so that there is a high probability that the acceleration process distributes the laundry articles along the inner circumferential wall of the drum with adequate evenness along the circumferential direction. Thus, the eccentric load will be reduced with high probability.

In the above-described control process, however, the laundry articles may remain unevenly distributed along the inner circumferential wall of the drum even after the acceleration of the drum. In this case, rotating the drum at high speeds will cause an abnormal vibration or noise. Taking this into account, the drum type washing machine according to the present invention may further include:

an eccentric load determiner for detecting the eccentric load of the drum and determining whether or not the eccentric load is equal to or smaller than a predetermined upper limit under the condition that the speed of the drum is raised to a second speed by the dehydration start-up controller, and when the eccentric load determiner has determined that the eccentric load is larger than the predetermined upper limit, the dehydration start-up controller lowers the speed of the drum to a level for agitating the laundry articles contained in the drum and then reinitiates the start-up of the dehydrating operation.

The aforementioned second speed may be preferably higher than the speed where the centrifugal force acting on the laundry is equal to the gravitational force acting thereon and also low enough to allow a certain amount of eccentric load to be present without causing an abnormal vibration. In the case the eccentric load determiner has determined that the eccentric load is larger than the predetermined upper limit, it is highly probable that an abnormal vibration occurs if the speed is further raised, or that the use of an additional balancing mechanism cannot adequately correct the balance. Taking this into account, the dehydration start-up controller temporarily lowers the drum speed to a level where the drum agitates the laundry contained therein, and then retries the start-up of the dehydrating operation described earlier. While repeating the start-up of the dehydrating operation, the dehydration start-up controller can locate a timing to proceed to the subsequent steps, e.g. to raise the drum speed when the eccentric load has become equal to or smaller than the predetermined upper limit. Thus, the drum is assuredly prevented from being rotated at high speeds with an abnormally large eccentric load, and the abnormal vibration or noise is accordingly prevented.

In the drum type washing machine according to the present invention, the dehydration start-up controller may reverse the rotating direction of the drum and conduct the agitating operation in the reversed direction when the speed change detector detects a sudden change in the speed within a short period of time.

In most cases, a sudden change in the drum speed within a short period of time suggests the presence of a mass of tightly tangled laundry articles. In this case, continuing the agitating operation in the same direction is accompanied by only a small chance of adequately loosening the laundry articles. Therefore, the dehydration start-up controller reverses the rotating direction of the drum and conducts the agitating operation in the opposite direction. Reversing the rotating direction provides the laundry articles with a higher probability of being loosened and appropriately distributed, so that there will be more opportunities to raise the speed of the drum. Thus, if there is only a small chance that the laundry will be loosened, the rotating direction of the drum is quickly reversed to carry out the agitating operation more efficiently without continuing the previous, ineffective agitating operation. This operation will further shorten the time required to raise the drum speed to the level where the laundry can be adequately dehydrated.

In the drum type washing machine according to the present invention, the dehydration start-up controller may determine the timing for accelerating the drum by checking the speed change detected by the speed change detector during a time period approximately corresponding to a half rotation of the drum.

This operation not only assuredly detects a decrease in the change of the drum speed due to the motion of the laundry articles but also enables the drum speed to be raised before the distribution of the laundry articles worsens again. Therefore, there is a higher probability of adequately distributing the laundry articles along the inner circumferential wall of the drum to reduce the eccentric load.

The motion of the laundry articles in the drum during the agitating operation depends on their amount (or load) and cloth types. Therefore, even if an agitating operation at a certain speed is found unsuccessful in loosening the laundry articles, it is still possible that another agitating operation at a slightly different speed can effectively loosen them. Taking this into account, the drum type washing machine according to the present invention may be constructed so that the first speed for the agitating operation is changed after the start-up of the dehydrating operation is retried a predetermined number of times.

In another mode of the present invention, the drum type washing machine further includes a load detector for detecting the load of the laundry articles contained in the drum before the dehydrating operation, and the first speed is determined according to the load detected.

More specifically, the first speed may preferably be set higher for larger magnitudes of loads than for smaller ones. For a relatively large amount of laundry articles, if the agitating operation is carried out at a higher speed, a portion of the laundry articles are pressed onto the inner circumferential wall of the drum while the other articles are agitated within the inner space. This operation is more efficient in evenly distributing a large amount of laundry articles than the operation that moves the laundry articles along the inner circumferential wall of the drum only during the time period in which the drum is being accelerated.

Thus, the drum type washing machine according to the present invention assuredly catches an appropriate timing for raising the speed of the drum and starts accelerating the drum at the earliest possible timing in the course of the agitating operation. It also increases the probability that the laundry is adequately distributed along the circumferential direction and the eccentric load is accordingly small when the speed of the drum has reached the level where the laundry is pressed onto the inner circumferential wall of the drum. This reduces the necessity for retrying the low-speed agitating operation, which is required when the eccentric load is large. As a result, the drum speed can be raised in a shorter time to a level where the laundry can be adequately dehydrated. This shortens not only the time required for the dehydrating operation but also the total operation time.

DETAILED DESCRIPTION OF A PREFERRED EMBODIMENT

A drum type washing machine as an embodiment of the present invention is described with reference to the attached drawings.

Figure 1:
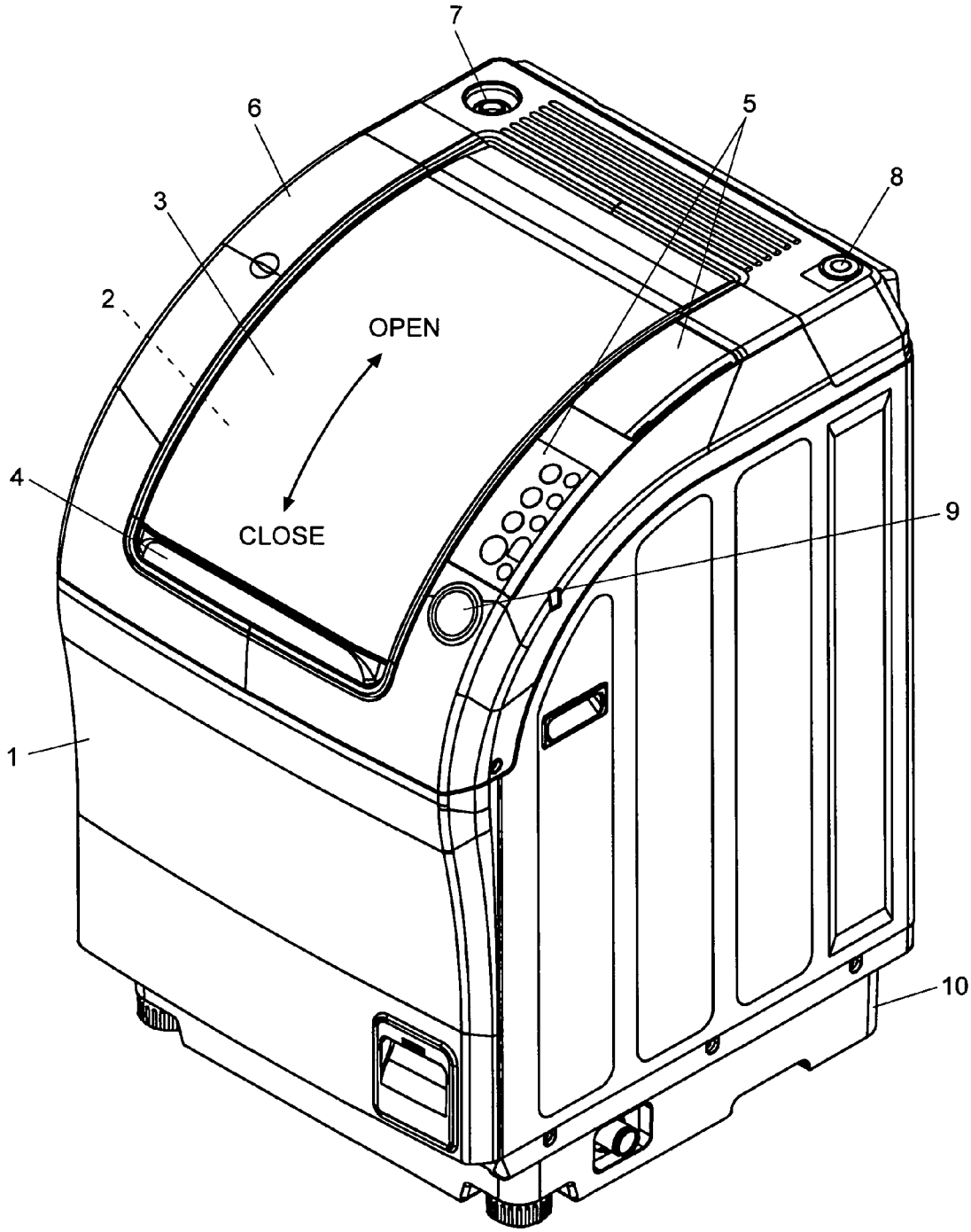
FIG. 1 is a perspective view of an embodiment of the drum type washing machine according to the present invention.
Figure 2:
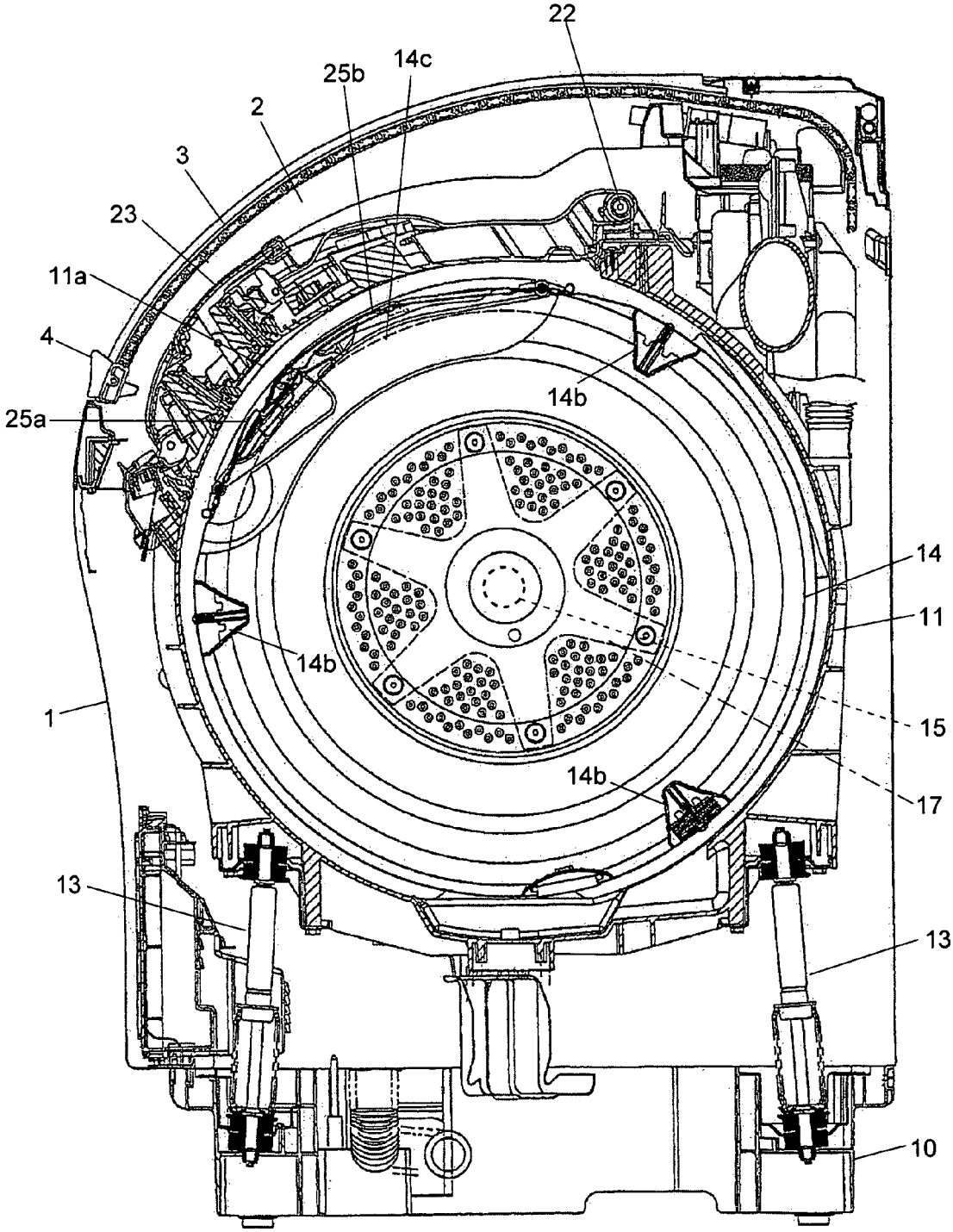
FIG. 2 is a vertical sectional view of the main part of the drum type washing machine of the embodiment, viewed from the right side.
Figure 3:
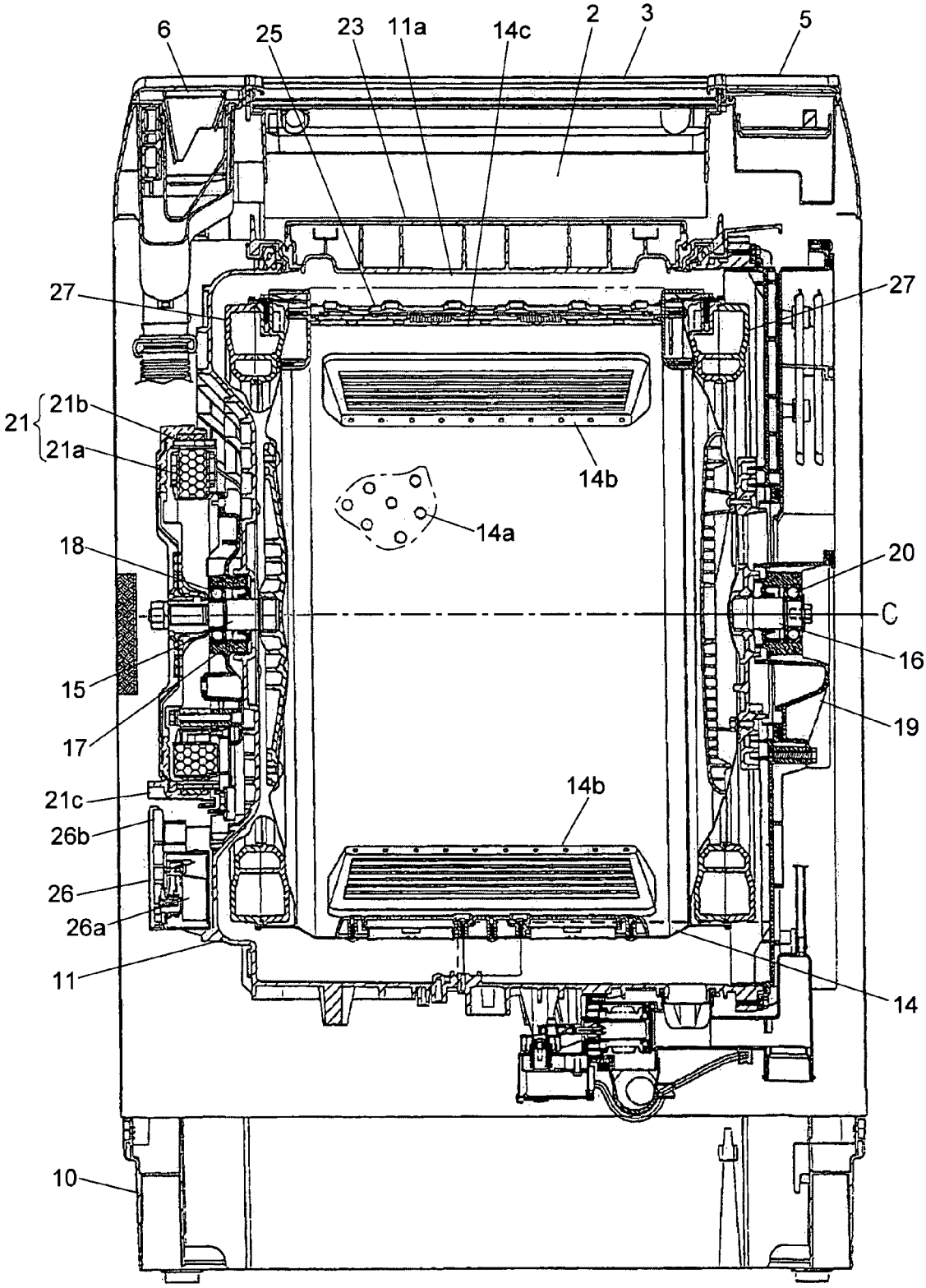
FIG. 3 is a vertical sectional view of the main part of the drum type washing machine of the embodiment, viewed from the front.

FIG. 1 is a perspective view of the drum type washing machine, FIG. 2 is a vertical sectional view of the main part of the drum type washing machine viewed from the right side, and FIG. 3 is a vertical sectional view of the main part of the drum type washing machine viewed from the front.

The housing 1 of the present washing machine has a curved surface extending from the top to the front and having a large opening 2 through which the laundry is to be loaded. The opening 2 can be closed with the shutter 3 consisting of slats linked in series, which can slide along the curved surface in the rear-to-front direction. With the shutter 3 in the closed position, if the user presses the button 9 located on the right side of the shutter 3, the shutter 3 automatically slides backwards to uncover the opening 2, as indicated by the arrow in FIG. 1. To close the shutter 3, the user should pull the handle 4 located at the front end on the top of the shutter 3. When the shutter 3 reaches the position where the opening 2 is completely closed, a latching mechanism (not shown) operates to hold the shutter 3 in the closed position.

Located on the right side of the shutter 3 is an operation panel 5 extending in the rear-to-front direction, having operation keys and indicators. Those keys that are not frequently used are covered by the lid that can be raised backwards to allow access to the keys. Located on the other side of the shutter 3 is a detergent container 6 covered with a lid that can be raised sideward. The water supply port 7 located behind the detergent container 6 is used to draw water from an external tap or a similar water resource through a hose. The bath water supply port 8 is located behind the operation panel 5 is used to draw water from a bathtub or a similar water resource through another hose.

The internal structure of the drum type washing machine in this embodiment is outlined, with reference to FIGS. 2 and 3. Within the housing 1, an outer tub 11 is located above the base 10. The outer tub 11 has an approximately cylindrical circumferential wall with both end faces substantially closed and directed to both sides of the housing 1, respectively. The outer tub 11 is hung on two springs 13 on both sides and also supported from below by two dampers 13 at the front and the back. This structure allows the outer tub 11 to make a moderate oscillation. The outer tub 11 encloses a drum 14 having an approximately cylindrical circumferential wall with a large number of perforations 14*a*. The drum 14, both ends of which are substantially closed, can rotate around the horizontal axis C extending along the right-to-left direction. The drum 14 has three baffles 14*b* fixed to its inside at angular intervals of about 120 degrees.

The main shaft 15 connected to the center of the left end face of the drum 14 is supported by a bearing 18 held by the first bearing case 17 fixed to the left side wall of the outer tub 11. The auxiliary shaft 16 connected to the center of the right end face of the drum 14 is supported by another bearing 20 held by the second bearing case 19 fixed to the right side wall of the outer tub 11. The two shafts 15 and 16 define the rotation axis of the drum 14, i.e. the horizontal axis C.

The tip of the main shaft 15 penetrates the left end face of the outer tub 11 to the outside, and the disc-shaped rotor 2*b* of the drum motor 21, which is an outer-rotor type DC motor, is fixed to the tip. The stator 21*a* of the drum motor 21 is fixed to the first bearing case 17 serving as a motor base. The stator 21*a* faces the magnets attached to the rotor 21*b*. When a driving current is supplied from the control circuit (not shown) to the stator 21*a* and the rotor 21*b* rotates accordingly, the main shaft 15 connected to the rotor 21*b* drives the drum 14 to rotate at the same speed as that of the rotor 21*b*.

The outer tub 11 has an outer tub opening 11*a* extending from the top to the front along the curved surface of the outer tub 11. The outer tub opening 11*a*, which is located at the same position as the opening 2 of the housing 1, is provided with an inner lid 23 that can be raised backwards around the shaft 22 extending along the right-to-left direction. Similarly, the drum 14 has a drum opening 14*c* formed in its circumferential wall. The drum opening 14*c* is provided with a drum door 25 consisting of double doors 25*a* and 25*b* opening outwards. To open or close the drum door 25, it is necessary to stop and hold the drum 14 at the position where the drum opening 14*c* is located at the same angular position as that of the outer tub opening 11*a* the drum 14. For this purpose, there is a drum-locking mechanism 26 located below the stator 21*a* on the left end face of the outer tub 11. The drum-locking mechanism 26 has an engagement pin 26*b* that moves up and down according to the operation of the built-in torque motor 26*a*. When the engagement pin 26*b* is pushed upwards and engaged with the cavity 21*c* located at a predetermined angular position on the rotor 21*b*, the drum 14 is locked and prevented from rotating.

The drum 14 has two balancing chambers 27, each attached to the circumferential edge of each end face of the drum 14. The balancing chamber 27 is a hollow circular body for suppressing the vibration of the drum 14 caused by an eccentric load due to an uneven distribution of the laundry when the drum 14 is rotated at high speed for dehydration. The operation of suppressing the vibration using the balancing chambers 27 is described later. In addition, a heating and blowing system including a fan motor, a drying heater and a watercooled dehumidifier is located on the outside of the right end face of the outer tub 11. This system supplies a flow of hot, dry air along the auxiliary shaft 16 into the drum 14 and then removes the air from the outer tub 11 with the moisture released from the wet laundry articles in the drum 14 through a heat exchange process. The damp air is dehumidified, dried and reused as dry air.

Figure 4:
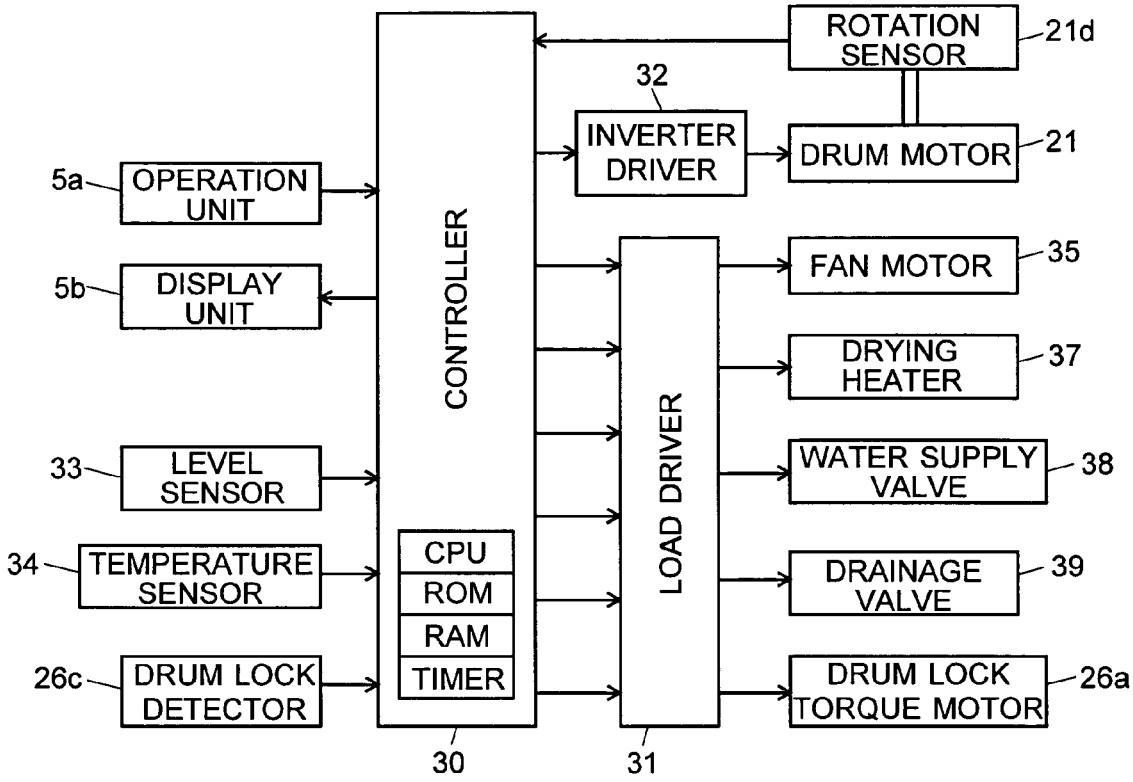
FIG. 4 is a diagram of the electrical construction of the main part of the drum type washing machine in the embodiment.

FIG. 4 shows the electrical construction of the main part of the drum type washing machine in the present embodiment. The controller 30, which corresponds to the dehydration start-up controller of the present invention, is mainly composed of a central processing unit (CPU), a read only memory (ROM), a random access memory (RAM), a timer and other elements. Executing a control program stored in the ROM, the controller 30 conducts the washing, rinsing, dehydrating and other operations.

The controller 30 receives various signals from other elements. For example, it receives key operation signals from the operation unit 5*a* contained in the operation panel 5 that allows users to set up or instruct the controller 30. Also, the controller 30 is fed with detection signals from: the level sensor 33 for detecting the water level within the outer tub 11; the temperature sensor 34 for detecting the temperature of the water stored in the outer tub 11 or that of the dry air supplied during the drying operation; and the drum lock detector 26*c*, included in the drum-locking system 26, for determining whether the drum is in the locked or released state.

The controller 30 controls the rotation of the drum motor 21 through an inverter driver 32 while receiving signals from a rotation sensor 21*d* that generates a train of pulse signals synchronized with the rotation of the drum motor 21. The rotation sensor 21*d* is a position sensor using a Hall element. It generates seventy-two pulses at equal angular intervals for each rotation of the drum motor 21, or for each rotation of the drum 14. When the drum motor 21 is rotating at an accurately constant speed, the pulse signals are generated at equal intervals of time, and the controller 30 can detect the speed of the drum motor 21 by measuring the time between two adjacent pulse signals. This means that the controller 30 and the rotation sensor 21*d* constitute the speed change detector of the present invention.

The controller 30 sends control signals through the load driver 31 to the following elements: a fan motor 35 and a drying heater 37 included in the heating and blowing system; a water supply valve 38 for controlling the water supply to the outer tub 11; a drainage valve 39 for controlling the drainage from the outer tub 11; and a torque motor 26*a* built in the drum locking system 26. The controller 30 also sends display signals to the display unit 5*b* to present information relating to the key operations performed on the operation unit 5*a* and the progress of the overall operation.

The detailed construction of the balancing chamber 27 and the vibration-suppressing operation using the balancing chamber 27 is described with reference to FIG. 5. The balancing chamber 27 is a hollow circular body containing a predetermined amount of liquid (e.g. calcium chloride solution). It has a plurality of L-shaped partitions 272 located at predetermined angular intervals and extending inwards from the outer circumferential wall 271. The partitions 272 prevent the liquid from moving freely within the chamber 27. When the drum 14 is rotated at a speed where the centrifugal force acting on the liquid is greater than the gravitational force acting thereon, the liquid is displaced towards the outer circumferential wall of the chamber 272 and retained in the compartments 274. In this state, the liquid does not move from one compartment 174 to another, so that each compartment 274 can be regarded as a weight attached to the corresponding position.

In the above-described state, if all the compartments 274 retain the same amount of liquid, the eccentric load due to the balancing chamber 27 is approximately zero. Otherwise, if a relatively larger amount of liquid is retained in one or more compartments 274, the mass distribution within the balancing chamber 27 around the rotation axis is unbalanced, causing an eccentric load. If there is another eccentric load due to an uneven distribution of the laundry articles pressed onto the inner circumferential wall of the drum 14 and rotating around the axis, it is now possible to reduce the total eccentric load by appropriately controlling the eccentric load of the balancing chamber 27 so as to cancel the eccentric load caused by the laundry articles. This means that an appropriate control of the position and the amount of the eccentric load existing within the balancing chamber 27 will make the total eccentric load of the drum 14 so small as to prevent an abnormal vibration.

The balancing operation using the balancing chamber 27 takes the following steps. At the beginning, the drum 14 is rotated at a speed where the centrifugal force acting on the liquid contained in the balancing chamber 27 is approximately equal to the gravitational force acting thereon. In this embodiment, the speed is about 65 to 75 r.p.m. At this speed, the outer portion of the liquid contained in the compartments 274 is pressed by the centrifugal force onto the circumferential wall of the balancing chamber 27, whereas the inner portion of the liquid is pulled by the gravitational force and falls from upper compartments 274 to lower ones. Therefore, it is possible to supply all the compartments 274 with an approximately equal amount of the liquid by rotating the drum 14 at the aforementioned speed for a certain period of time. With the liquid distributed evenly, the eccentric load due to the balancing chamber 27 is approximately zero, and only the eccentric load W due to the uneven distribution of the laundry constitutes the total eccentric load of the drum 14 (FIG. 5A).

Next, the speed of the drum is raised to a slightly higher level so as to increase the centrifugal force acting on the liquid retained in the compartments 274 and accordingly stabilize the retained liquid. The second speed is usually about 100 r.p.m. At this speed, the total eccentric load of the drum 14 is calculated from the change in the speed of the drum 14 or the rotor 21*b*. Then, the drum 14 is decelerated for a short period of time at a timing determined according to the position of the eccentric load detected. This operation reduces the centrifugal force acting on the liquid, so that, as shown in FIG. 5B, some portion of the liquid retained in the compartments 274*a*, 274*b* and 274*c* approaching the top of the drum 14 spills out and falls into other compartments traveling below.

Figure 5A:
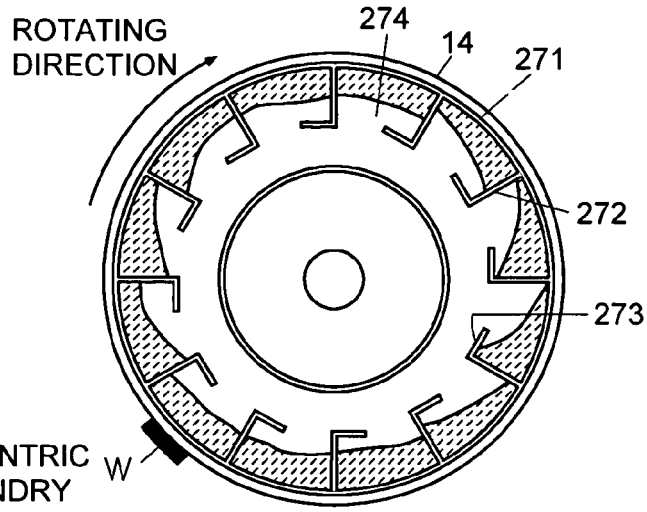
FIGS. 5A-5C are illustrations for explaining the process of suppressing vibrations using balancing chambers in the drum type washing machine in the embodiment.
Figure 5B:
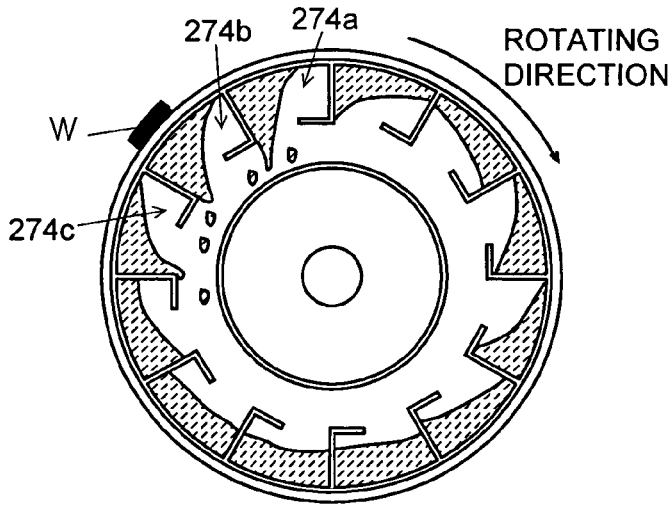

As shown in FIG. 5A, immediately before the deceleration, the liquid held in the compartments approaching the top of the drum 14 is relatively easy to fall, whereas the liquid retained in the compartments that have passed the top and entered the descending phase of the rotation rarely spills out because the blocking part 273 of the partition 272 prevents it from spilling. Therefore, when the speed is temporarily lowered as described above, the compartment located at the top or approaching the top allows the liquid to spill out, while the compartment moving downwards safely retains the liquid. This means that the probability that the liquid is allowed to escape from a compartment is particularly high when the compartment is within a specific phase of rotation. Taking this into account, the timing of deceleration can be determined so that the amount of the liquid retained in the compartments located close to the eccentric load W due to the uneven distribution of the laundry is decreased while the amount of the liquid held in the opposite compartments is increased.

Figure 5C:
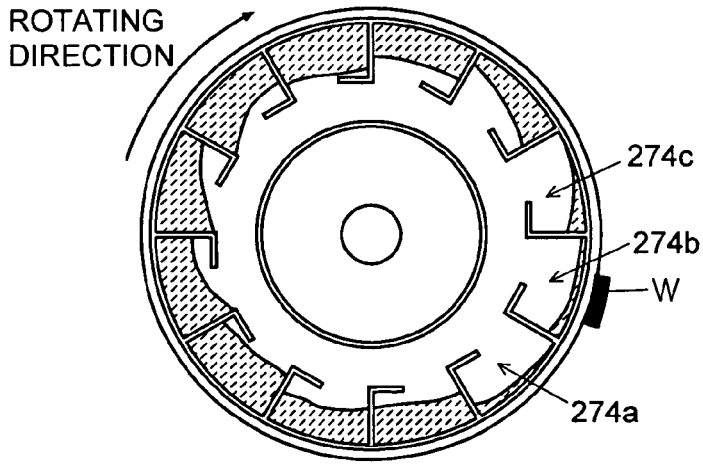

After the above-described decelerating operation is carried out once or multiple times, the balancing chamber 27 reaches a state shown in FIG. 5C, where the compartments 274*a*, 274*b* and 274*c* located at or close to the eccentric load W hold only a small amount of liquid whereas the opposite compartments retain a greater amount of liquid. In this state, the eccentric load due to the uneven distribution of the laundry is balanced due to the balancing chamber 27, so that the total eccentric load of the drum 14 is smaller than previously.

As described above, the drum type washing machine in this embodiment is capable of actively reducing the total eccentric load by carrying out the balancing operation using the balancing chambers 27. However, this does not guarantee that the eccentric load can be always canceled. The maximal amount of the eccentric load that can be adjusted with the balancing chamber 27 is determined by the maximal displacement of the liquid. The idea of making the adjustable range adequately large is impractical because the balancing chamber 27 and the compartments 274 are limited in size and the total amount of the liquid is accordingly restricted. Therefore, it is desirable to decrease the eccentric load W by distributing the laundry as evenly as possible along the inner circumferential wall of the drum 14 in advance of the balancing operation using the balancing chamber 27. To effectively distribute the laundry articles, it is essential to loosen them at the beginning because they are often tangled with each other immediately after the washing or rinsing process.

Figure 6:
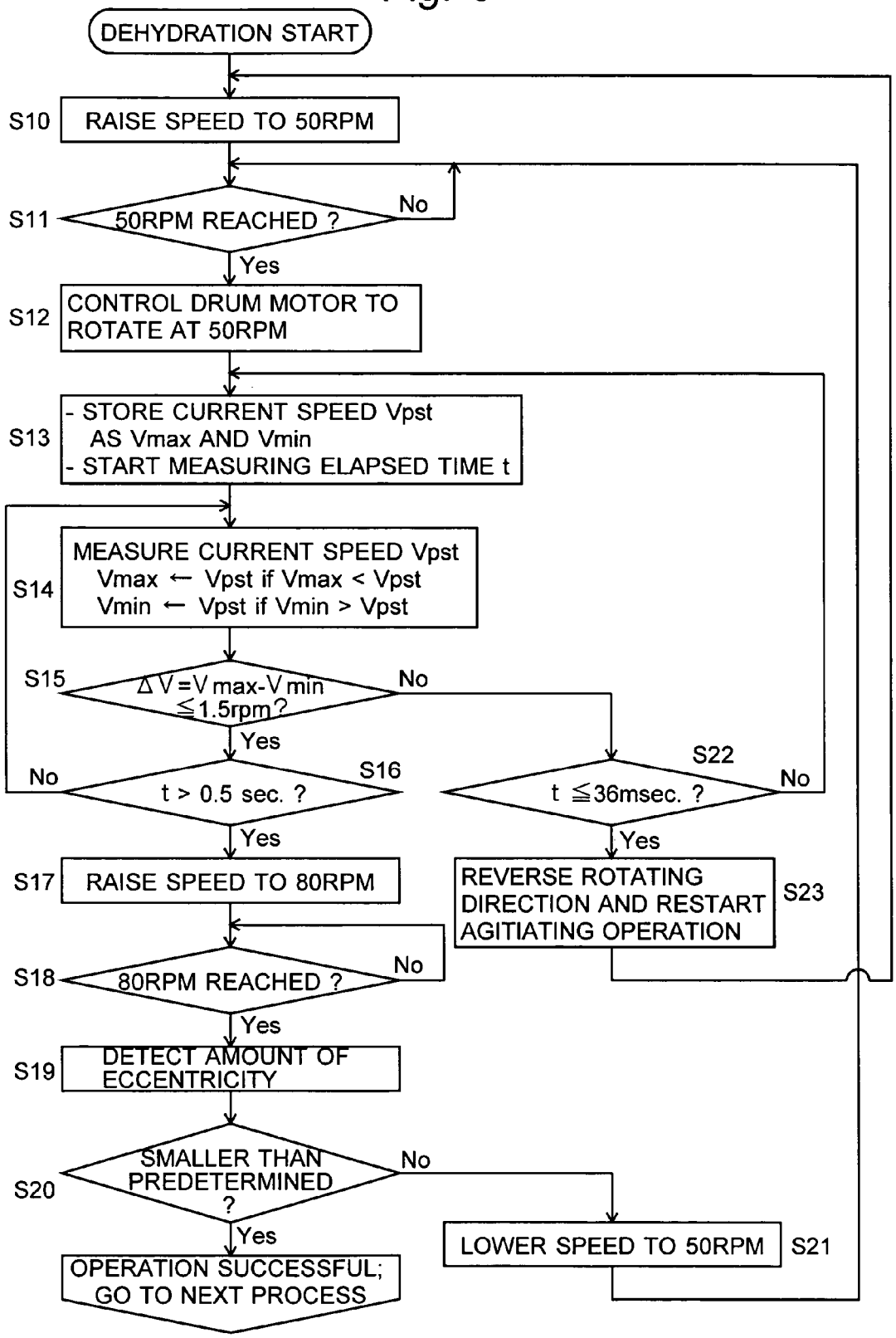
FIG. 6 is a flowchart showing the control process of the start-up of the dehydrating operation in the drum type washing machine in the embodiment.
Figure 7A:
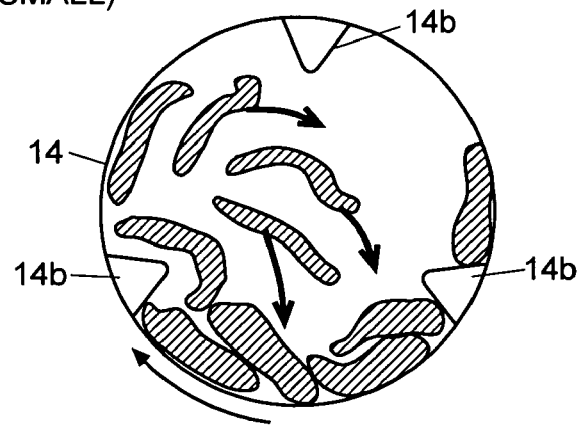
FIGS. 7A-7C are illustrations showing the state of the laundry at the start-up of the dehydrating operation in the drum type washing machine in the embodiment.
Figure 7B:
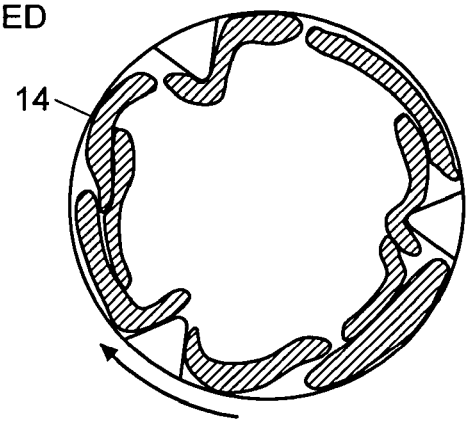
Figure 7C:
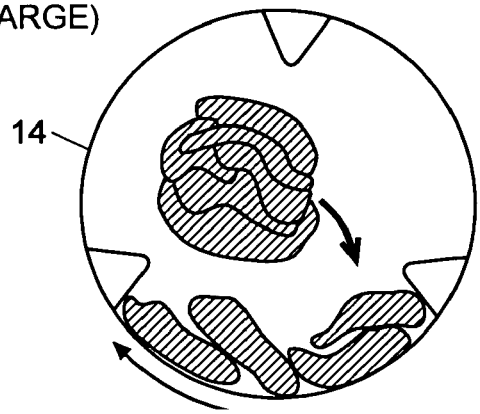

To meet such demands, the drum type washing machine in this embodiment carries out a characteristic control operation at the start-up of the dehydrating operation, as illustrated in FIGS. 6 and 7A-7C, where FIG. 6 is a flowchart of the start-up process of the dehydrating operation, and FIGS. 7A-7C are schematic drawings showing the states of the laundry within the drum. It should be noted that the washing machine in this embodiment has two dehydration modes: intermediate dehydration and final dehydration. The intermediate dehydration is carried out after the washing operation or an intermediate rinsing operation, and the final dehydration is performed after the final rinsing operation. In the following description, the dehydrating operation may be either of the two modes.

When a dehydrating operation is started, the controller 30 energizes the drum motor 21 through the inverter driver 32 so that the speed of the drum 14 is raised to a level of 50 r.p.m. at which the drum 14 agitates the laundry (Step S10). This speed corresponds to the first speed in the present invention. When the speed calculated from the pulse signals generated by the rotation sensor 21*d* has reached 50 r.p.m. ("Yes" in Step S10), the controller 30 sets the target speed at 50 r.p.m. and controls the drum motor 21 to constantly rotate at that speed (Step S12). More specifically, the controller 30 calculates the difference between the present speed Vpst calculated from the pulse signals received from the rotation sensor 21*d* and the target speed, and adjusts the power supply to the drum motor 21 so that the speed difference becomes zero. When the drum 14 is rotated at this speed, the laundry contained in the drum 14 is usually agitated as shown in FIG. 7A.

Subsequently, the controller 30 stores the value of the present speed Vpst as the maximum speed Vmax and the minimum speed Vmin and starts measuring the elapsed time t (Step S13). In other words, at the elapsed time t=0, both Vmax and Vmin are initialized as Vpst.

After that, upon receiving the next pulse signal from the rotation sensor 21*d*, the controller 30 re-calculates the present speed Vpst, taking into account the new pulse signal, and compares the new value of Vpst with the maximum speed Vmax stored previously. If Vmax<Vpst, the maximum speed Vmax is updated with the new value of Vpst. If not Vmax<Vpst, the controller 30 compares the new speed Vpst with the minimum speed Vmin. If Vmin>Vpst, the minimum speed Vmin is updated with the new value of Vpst (Step S14). Then, the controller 30 calculates the difference ΔV between the maximum speed Vmax and the minimum speed Vmin and determines whether the speed difference ΔV is equal to or smaller than 1.5 r.p.m. (Step S15) If ΔV does not exceed 1.5 r.p.m., the controller 30 determines whether the elapsed time t is longer than 0.5 second (Step S16). If t is not longer than 0.5 second, the operation returns to Step S14.

If, in Step S15, the speed difference ΔV is larger than 1.5 r.p.m., the operation proceeds to Step S22, where the controller 30 determines whether the elapsed time t is equal to or shorter than 36 milliseconds. If the operation proceeds from Step S14 through Step S15 to Step S22 and the determination in Step S22 results in "Yes", it means that the speed has changed by a large amount greater than 1.5 r.p.m. within a short period of time and less than 36 milliseconds. The most probable reason for such a sudden speed change is the presence of a mass of tightly tangled laundry articles that falls or tumbles in the drum 14, as shown in FIG. 7C. Once such a mass of laundry articles is formed, there is only a small chance that the laundry articles become adequately loosened through the agitating operation continued in the same direction. Therefore, in such a case, the controller 30 stops the drum 14 and restarts the agitating operation by rotating the drum 14 in the reversed direction (Step S23). Then, the control process starting from Step S10 is similarly carried out while the drum 14 is rotated in the reversed direction.

In the case the laundry is tightly tangled in a mass form, the state of the laundry might be worse (i.e. more tightened) rather than better (i.e. loosened) if the agitating operation were continued in the same direction. In such a case, the above-described process of reversing the rotating direction of the drum 14 and retrying the agitating operation is often effective in disentangling the laundry articles and making them easy to separate. This will break the mass and make the laundry articles easy to distribute.

If the operation proceeds from Step S14 through Step S15 to Step S22 and the determination result in Step S22 is "No", it means that the speed change is not sudden though its magnitude is considerably large. This suggests that the laundry articles are in the form of a simple pile that is easy to separate, not a tightly tangled mass. Therefore, the operation returns to Step S13, where the maximum speed Vmax and the minimum speed Vmin stored previously are discarded and the latest value of the speed Vpst is newly stored as the maximum speed Vmax and the minimum speed Vmin. In addition, the measurement of time is restarted with the value of t reset to zero. In short, returning from Step S22 to Step S13 means that the operation of checking the speed change is totally reset and restarted.

If the speed difference ΔV between the maximum speed Vmax and the minimum speed Vmin remains equal to or smaller than 1.5 r.p.m., the steps of S14, S15 and S16 are cyclically repeated until the elapsed time t exceeds 0.5 second. In the case the speed is 50 r.p.m., the drum 14 takes 1.2 second to complete one cycle of rotation. Therefore, the time 0.5 second corresponds to about a half rotation (more exactly, five twelfth of rotation). If the speed difference ΔV between the maximum speed Vmax and the minimum speed Vmin does not exceed 1.5 r.p.m. for about a half rotation, it is possible to conclude that the change in the speed of the drum 14 is adequately small.

A large change in the speed of the drum 14 mostly results from a mass of the laundry articles moving in the drum 14. Conversely, if there is only a small change in the drum speed, it means that the laundry articles are tumbling in an easy-to-separate state without forming a mass or pile, as shown in FIG. 7A. Starting from this state, if the speed of the drum 14 is raised, there is a high probability that the separated laundry articles are moderately distributed along the circumferential direction of the drum 14 and pulled by the centrifugal force onto the circumferential wall of the drum 14 one after another. Ultimately, the laundry articles will reach an appropriately distributed state. Therefore, if the determination in Step S16 result in "Yes", the controller 30 raises the speed of the drum 14 toward 80 r.p.m., a speed at which the centrifugal force acting on the laundry contained in the drum 14 exceeds the gravity acting thereon (Step S17). When the speed has reached 80 r.p.m. ("Yes" in Step S18), the controller 30 detects the eccentric load due to the distribution of the laundry while maintaining the speed (Step S19).

In Step S16, the time for monitoring the speed difference ΔV is set at 0.5 second for the following reason. During the agitating operation, the state of the agitated laundry rapidly changes with the lapse of time. Therefore, if the time for monitoring the speed difference ΔV is much shorter, e.g. 0.1 second, there is a chance that the speed of the drum 14 is raised at a wrong timing where the speed difference ΔV momentarily decreases even though a pile or mass of the laundry still exists. In contrast, if the monitoring time is much longer, e.g. 1 second, the laundry articles that have been once separated will gather again with high probability, so that the agitating operation will continue for a long period of time. Setting the monitoring time at 0.5 second (or a half rotation of the drum 14) meets the requirements of detecting a good timing at which the laundry is adequately distributed, and raising the speed of the drum 14 without missing that timing.

When the drum is rotated at 80 r.p.m., the laundry articles contained in the drum 14 are pressed onto the inner circumferential wall of the drum 14 and rotate with it, as shown in FIG. 7B. In this state, the total eccentric load reflects the distribution of the laundry articles. According to the present invention, the eccentric load is detected by analyzing the change in the speed of the drum 14, which is known from the pulse signals generated by the rotation sensor 21*d*. While the drum 14 is rotated at the constant speed of 80 r.p.m., the speed change will increase as the eccentric load becomes larger. Taking this into account, the controller 30 calculates the amount of the eccentric load from the speed change and determines whether the amount calculated is equal to or smaller than a predetermined value (Step S20). Thus, the rotation sensor 21*d* and the controller 30 constitute the eccentric load determiner of the present invention. In Step S20, if the amount of the eccentric load exceeds the predetermined value, the controller 30 concludes that it is impossible to reduce the total eccentric load to a level where the abnormal vibration can be suppressed by carrying out the balancing operation using the balancing chambers 27 as previously described. Therefore, aborting the start-up of the dehydration, the controller 30 lowers the drum speed to 50 r.p.m. (Step S21) and returns to Step S11. Thus, the drum speed is reset to a level for agitating the laundry articles in the drum 14, and the control process starting from Step S11 is carried out again.

In Step S20, if the amount of the eccentric load is not larger than the predetermined value, the controller 30 concludes that the laundry articles are adequately distributed and proceeds to the next step. Specifically, the controller 30 raises the speed of the drum 14 to 100 r.p.m. and accurately detects the eccentric load at the speed. If the accurate eccentric load is adequately small, the controller 30 concludes that there is only a small chance of abnormal vibration. Therefore, the speed of the drum 14 is raised to a high speed of about 500 to 1000 r.p.m. Conversely, if the amount of the eccentric load detected at the drum speed of 100 r.p.m. is so large that the balancing operation using the balancing chambers 27 is required, the controller 30 controls the rotation of the drum 14 so as to move the liquid contained in the balancing chambers 27 as described earlier, while maintaining the speed of the drum 14. After that, the speed of the drum 14 is raised to the high speed for dehydration As described above, the drum type washing machine in this embodiment almost continuously monitors the speed change of the drum 14 that reflects the distributed state, or gathering state, of the laundry during the agitating operation. The speed of the drum 14 is raised at an appropriate timing where the laundry articles are adequately separated so that they can be evenly distributed with high probability. This operation increases the probability of reducing the eccentric load and accordingly shortens the time required for the start-up of the dehydrating operation. Furthermore, the drum type washing machine in this embodiment reverses the rotating direction of the drum 14 in the course of the loosening operation only when the laundry articles are tangled in a mass form, i.e. only when the loosening operation in the opposite direction is truly required. This prevents an unnecessary loss of time that can arise in a conventional washing machine constructed to regularly reverse the rotating direction of the drum if the dehydrating operation cannot start successfully.

In the above-described embodiment, the speed for the agitating operation is fixed at 50 r.p.m. However, this speed is not always optimal for loosening the laundry articles, because the motion of the laundry articles changes depending on the total amount of the laundry articles or on their cloth qualities. Taking this into account, it is allowable to change the drum speed for the agitating operation depending on the state of the operation. For example, the speed may be changed to 65 r.p.m. if the agitating operation at the speed of 50 r.p.m. has consecutively failed in starting the dehydrating operation (i.e. "No" in Step S20 in FIG. 6) a predetermined number of times (e.g. three times).

As described previously, the amount (or load) of the laundry influences the motion of the laundry articles during the agitating operation. Taking this into account, it is possible to determine the speed of the drum 14 for the agitating operation based on the load of the laundry detected immediately before the dehydrating operation. For example, the drum speed may be set at 50 r.p.m. for smaller load values or 65 r.p.m. for larger load values. The centrifugal force acting on a laundry article contained in the drum 14 increases as the laundry article is farther from the rotation axis of the drum 14. At the speed of 65 r.p.m., those laundry articles that are located closer to the inner circumferential wall of the drum 14 rotate with the drum 14 in the state of being moderately distributed along and pressed onto the inner circumferential wall of the drum 14, while the other laundry articles located closer to the rotation axis of the drum are agitated within the space surrounded by the laundry articles pressed on the inner circumferential wall of the drum 14. Therefore, it is least possible that an abnormal vibration occurs when the speed of the drum 14 is raised to 80 r.p.m., so that there is a high probability of successfully reducing the eccentric load.

In conclusion, it should be noted that any other change, modification or addition may be made to the above-described embodiment within the spirit and scope of the present invention.

What is claimed is:

1. A drum type washing machine for carrying out a dehydration of laundry articles by rotating a drum with the laundry articles contained therein at a high speed around a horizontal or inclined rotation shaft, comprising:

a motor for rotating the drum;

a speed change detector for detecting a change in a speed of the drum under a condition that the motor is controlled to rotate at a constant speed so that the drum rotates at a first speed for an agitating operation that agitates the laundry articles contained in the drum at a start-up of a dehydrating operation; and a dehydration start-up controller for controlling the motor so that the speed of the drum is raised to a speed where the laundry articles are pressed onto an inner circumferential wall of the drum by centrifugal force when the change in the speed detected by the speed change detector is smaller than a predetermined value, wherein the dehydration start-up controller reverses a rotating direction of the drum and conduct an agitating operation in the reversed direction when the speed change detector detects a sudden change in the speed within a short period of time during the first speed for agitating operation.

2. The drum type washing machine according to claim 1, further comprising: an eccentric load determiner for detecting an eccentric load of the drum and determining whether or not the eccentric load is equal to or smaller than a predetermined upper limit under a condition that the speed of the drum is raised to a second speed by the dehydration start-up controller, and when the eccentric load determiner has determined that the eccentric load is larger than the predetermined upper limit, the dehydration start-up controller lowers the speed of the drum to a level for agitating the laundry articles contained in the drum and then reinitiates the start-up of the dehydrating operation.

3. The drum type washing machine according to claim 2, wherein the first speed for the agitating operation is changed after the start-up of the dehydrating operation is retried a predetermined number of times.

4. The drum type washing machine according to claim 1, wherein the dehydration start-up controller determines a timing for accelerating the drum by checking the speed change detected by the speed change detector during a time period approximately corresponding to a half rotation of the drum.

5. The drum type washing machine according to claim 1, further comprising a load detector for detecting a load of the laundry articles contained in the drum before the dehydrating operation, and the first speed is determined according to the load detected.

* * * * *